United States Patent [19]

Kawakatsu et al.

[11] Patent Number: 4,600,688

[45] Date of Patent: Jul. 15, 1986

[54] SILVER HALIDE COLOR PHOTOGRAPHIC LIGHT-SENSITIVE MATERIAL

[75] Inventors: Satoshi Kawakatsu; Noritaka Nakayama; Katsunori Katoh, all of Hachioji; Kaoru Shinozaki, Tachikawa; Toshihiko Kimura, Hino, all of Japan

[73] Assignee: Konishiroku Photo Industry Co., Ltd., Japan

[21] Appl. No.: 699,958

[22] Filed: Feb. 8, 1985

[30] Foreign Application Priority Data

Feb. 10, 1984 [JP] Japan ..... 59-24653

[51] Int. Cl.[4] ..... G03C 7/26; G03C 7/32

[52] U.S. Cl. ..... 430/558; 430/505; 430/549; 430/554; 430/555

[58] Field of Search ..... 430/558, 505, 549, 554, 430/555

[56] References Cited

U.S. PATENT DOCUMENTS 3,725,067 4/1973 Bailey et al. ..... 430/558
4,338,393 7/1982 Bailey et al. ..... 430/558
4,503,141 3/1985 Furutachi et al. ..... 430/558
4,511,649 4/1985 Ogawa et al. ..... 430/505
4,524,132 6/1985 Aoki et al. ..... 430/552

*Primary Examiner*—Mary F. Downey
*Attorney, Agent, or Firm*—Finnegan, Henderson, Farabow, Garrett & Dunner

[57] ABSTRACT

A silver halide color photographic light-sensitive material whose magenta dye-forming layer forms a magenta dye image having an absorption maximum from 550 nm to 560 nm and an advantageous absorption spectrum for color reproduction is provided by a silver halide color photographic light-sensitive material comprising a support having thereon at least one silver halide emulsion layer, wherein the at least one silver halide emulsion layer contains a 1H-pyrazolo[3,2-C]-s-triazole-type magenta coupler, and the above silver halide emulsion layer containing the magenta coupler and/or a silver halide emulsion layer having substantially the same color sensitivity as does the above silver halide emulsion layer containing the magenta coupler contains a pyrazolone-type magenta coupler.

12 Claims, No Drawings

SILVER HALIDE COLOR PHOTOGRAPHIC LIGHT-SENSITIVE MATERIAL

BACKGROUND OF THE INVENTION

1. Field of the Invention

This invention relates to a silver halide photographic light-sensitive material, and more particularly it relates to the improvement on the absorbing spectrum and preservability of the image formed in the magenta color image-forming layer of a silver halide color photographic light-sensitive material.

2. Description of the Prior Art

Generally speaking, in a silver halide color photographic light-sensitive material, the exposed silver halide particles are reduced by an aromatic primary amine-type color developing agent, and the oxidized product of the color developing agent, produced in the above reaction, then effects coupling reactions with yellow, magenta and cyan dye-forming couplers, whereby a dye image can be obtained.

The coupler, which has conventionally been used for the formation of the above-mentioned magenta dye, includes pyrazolone-type magenta couplers. The couplers, however, are disadvantageous in respect that they produce no satisfactorily high maximum color densities (hereinafter abbreviated to Dmax), lower the speed of the emulsion combinedly used therewith, and have undesirable secondary spectral absorptions, and besides, are poor in the preservability, particularly, because they are apt to be affected by a formalin vapor, which causes remarkable changes in the tone of the formed color therefrom as well as the deterioration of the color formability thereof (poor in the resistance to formalin).

For the improvement of such disadvantages many proposals have been made to date. For example, Japanese Patent Examined Publication No. 30895/1973 discloses secondary absorption-free 1H-pyrazolo[3,2-C]-s-triazole-type magenta couplers. The couplers, however, provide no satisfactory Dmax nor high emulsion speed, and are hardly improved on the resistance to formalin.

Japanese Patent Examined Publication No. 16058/1974 discloses bis-structural pyrazolone-type magenta couplers. The couplers, although considered improved to a certain extent on the resistance to formalin as well as on the speed, have no satisfactory Dmax. Japanese Patent Publication Open to Public Inspection (hereinafter referred to as Japanese Patent O.P.I. Publication) No. 133734/1981 discloses magenta couplers of the type of 1H-pyrazolo[3,2-C]-s-triazole which is combined at the first position thereof with the active methylene group of an active methylene compound. The couplers, although improved on the resistance to formalin to a certain extent, are not satisfactory in respect of the Dmax and speed. Japanese Patent O.P.I. Publication No. 42045/1983 discloses, for the purpose of improving the Dmax, a ballasting group for magenta couplers, the ballasting group having at the terminal thereof hydroxyphenylenesulfonyl and sulfenyl groups, but it is still unsatisfactory.

These 1H-pyrazolo[3,2-C]-s-triazole-type magenta couplers have the disadvantage that the absorption maximum of the dye formed therefrom does not fall under the magenta dye's desirable absorption maximum (λmax) range (550 nm to 560 nm) for the color reproduction in negative images. Thus, that the λmax is not in the desirable range is the undesirable phenomenon for the color reproduction in making color prints. Also, those couplers disclosed in Japanese Patent O.P.I. Publication No. 42045/1983, although the λmax of the magenta dye produced therefrom is improved so as to be 552 nm, as noted, are poor not only in the speed as well as in the Dmax but also in the dispersion stability.

SUMMARY OF THE INVENTION

Objects of the Invention

It is, therefore, an object of this invention to provide a silver halide color photographic light-sensitive material whose magenta dye-forming layer forms a magenta dye image having an absorption maximum from 550 nm to 560 nm and an advantageous absorption spectrum for the color reproduction.

It is a another object of this invention to provide a silver halide color photographic light-sensitive material which is excellent in the preservability, particularly in the resistance to formalin.

It is a further object of this invention to provide a silver halide color photographic light-sensitive material which is excellent in the color formability.

Construction of the Invention

The above objects of the present invention are accomplished by the following silver halide color photographic light-sensitive material: In a silver halide color photographic light-sensitive material comprising a support having thereon at least one silver halide emulsion layer, the silver halide color photographic light-sensitive material wherein the at least one silver halide emulsion layer contains a 1H-pyrazolo[3,2-C]-s-triazole-type magenta coupler, and the above silver halide emulsion layer containing the magenta coupler and/or a silver halide emulsion layer having substantially the same color sensitivity as does the above silver halide emulsion layer containing the magenta coupler contains a pyrazolone-type magenta coupler.

That is, the incorporation of a 1H-pyrazolo[3,2-C]-s-triazole-type magenta coupler and a 3-acylamino-2-pyrazoline-5-one-type magenta coupler both into a same emulsion layer, or the incorporation of the former into an emulsion layer and of the latter into the above emulsion layer and/or a different emulsion layer having substantially the same color sensitivity as does the above emulsion layer makes up for the disadvantage of the 1H-pyrazolo[3,2-C]-s-triazole-type magenta coupler such that the λmax of a dye image formed therefrom does not fall under the 550 nm-to-560 nm range, and also enables the improvement on the resistance to formalin. This is considered to be a very significant phenomenon in the light of the fact that, if the coupler to be used in combination with the 1H-pyrazolo[3,2-C]-s-magenta coupler is one outside this invention, the λmax not only shifts toward a longer wavelength region but, in some cases, also shifts toward a shorter wavelength region, and further the inadequate resistance to formalin of the magenta coupler used alone can be improved by use of both the couplers in combination. This effect was not expected from the merely combined use of simple couplers only.

DETAILED DESCRIPTION OF THE INVENTION

The terms "substantially the same color sensitivity" used herein implies that the maximum absorption of the color sensitivity falls under the spectral region of each of blue, green and red colors.

The foregoing 1H-pyrazolo[3,2-C]-s-triazole-type magenta coupler includes preferably those compounds having the following Formula [I], and the foregoing pyrazolone-type magenta coupler includes preferably those compounds having the following Formula [II]:

Formula [I]

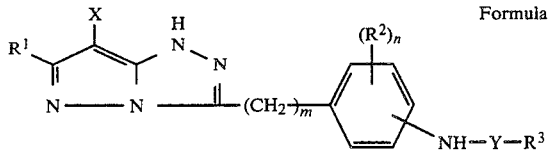

wherein $R^1$ is an alkyl or aryl group, $R^2$ is a monovalent organic group, $R^3$ is an alkyl, aryl or heterocyclic group, Y is a carbonyl or sulfonyl group, X is a hydrogen atom or a group that can be split off by the coupling reaction thereof with the oxidized product of an aromatic primary amine color developing agent, m is an integer of from zero to 5, and n is an integer of from zero to 4.

Formula [II]

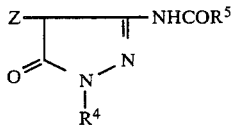

wherein $R^4$ is an aryl group, $R^5$ is an alkyl or aryl group, Z is a hydrogen atom or a group that can be split off by the coupling reaction thereof with the oxidized product of an aromatic primary amine color developing agent.

The pyrazolotriazole-type coupler represented by Formula [I] will be detailed below: The $R^1$ represents an alkyl or aryl group, and preferably an alkyl group. The alkyl group is preferably an alkyl group having from 1 to 8 carbon atoms, and more preferably a straight-chain or branched-chain alkyl group having from 1 to 4 carbon atoms, which is allowed to have a substituent such as methyl, ethyl, methoxymethyl or t-butyl group.

Where the $R^1$ is an aryl group, the preferred example is a phenyl group, which is allowed to have a substituent such as an alkyl group, an alkoxy group, a halogen atom, a nitro group or an alkoxycarbonyl group.

The $R^2$ is a halogen atom or a monovalent organic group such as an alkoxy, alkyl, nitro, alkoxycarbonyl or cyano group.

The $R^3$ is an alkyl, aryl or heterocyclic group. The alkyl group is preferably one having from 4 to 32 carbon atoms, which is allowed to have a substituent. The aryl or heterocyclic group is preferably one having not less than one substituent having from 4 to 32 carbon atoms. The heterocyclic group may be of either 5- or 6-member cyclic ring, such as, e.g., pyridyl, imidazolyl, benzimidazolyl or the like group. Z is a hydrogen atom or a group that can be split off by the coupling reaction thereof with the oxidized product of an aromatic primary amine color developing agent, and also represents the residue of a compound produced after the split-off, the residue being such as a halogen atom (bromine or chlorine atom), an aryloxy group (such as phenoxy, p-methoxyphenoxy, p-butanesulfonamidophenoxy group, etc.), an arylthio group (such as phenylthio, t-butylphenylthio group), an alkylthio group (such as ethylthio, dodecylthio, benzylthio, etc.), or the like.

The preferred one among these is a halogen atom, and more preferably a chlorine atom. Y is a carbonyl group or a sulfonyl group. The m is an integer of from zero to 5, and the n is an integer of from zero to 4.

The following are the preferred examples of the 1H-pyrazolo[3,2-C]-s-triazole-type magenta couplers usable in this invention. The present invention is not limited by the following examples.

Formula [I]

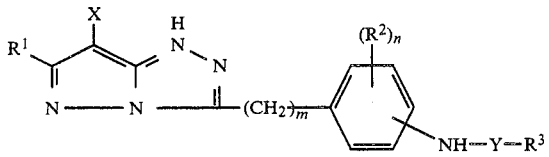

| Coupler | $R^1$ | m | $(R^2)_n$ NH | X | Y | $R^3$ |
|---|---|---|---|---|---|---|
| I-1 | $-CH_3$ | 3 | 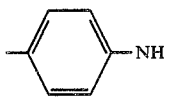 | Cl | —CO— | 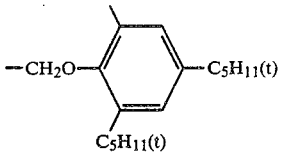 |
| I-2 | $-CH_3$ | 3 | 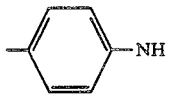 | Cl | —CO— | 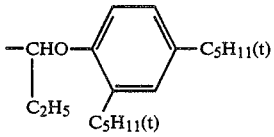 |

-continued
Formula [I]
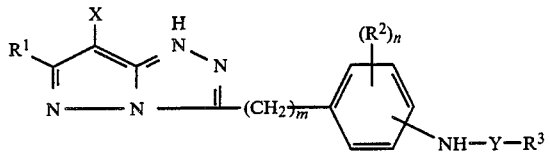
| Coupler | $R^1$ | m | 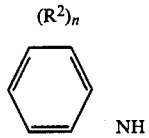 | X | Y | $R^3$ |
|---|---|---|---|---|---|---|
| I-3 | $-CH_3$ | 3 | 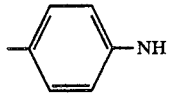 | Cl | $-CO-$ | 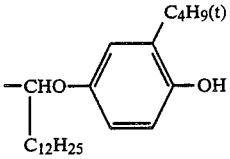 |
| I-4 | $-CH_3$ | 3 | 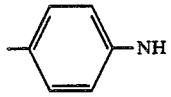 | Cl | $-CO-$ | 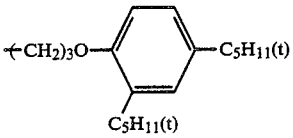 |
| I-5 | $-CH_3$ | 2 | 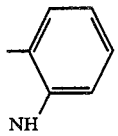 | Cl | $-CO-$ | $-C_{11}H_{23}$ |
| I-6 | $-CH_3CH_2$ | 0 | 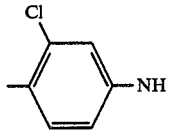 | Cl | $-CO-$ | 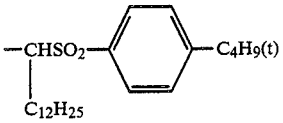 |
| I-7 | $-CH_3OCH_2$ | 1 | 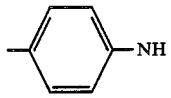 | Cl | $-SO_2-$ | $-C_{12}H_{25}$ |
| I-8 | $-CH_3$ | 3 | 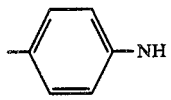 | Cl | $-SO_2-$ | 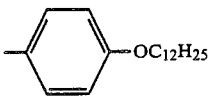 |
| I-9 | $-CH_3$ | 3 | 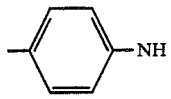 | Cl | $-CO-$ | 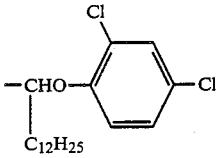 |
| I-10 | $t\text{-}C_4H_9-$ | 3 | 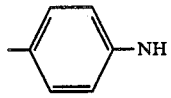 | 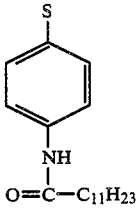 | $-CO-$ | $-CH_3$ |

-continued

Formula [I]

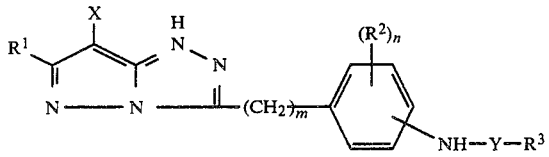

| Coupler | $R^1$ | m | NH | X | Y | $R^3$ |
|---|---|---|---|---|---|---|
| I-11 | 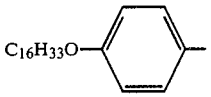 | 1 | 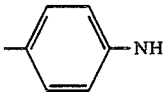 | Cl | —CO— | —$CH_3$ |
| I-12 | —$CH_3$ | 3 | 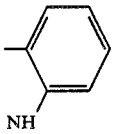 | H | —CO— | 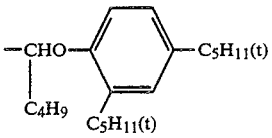 |
| I-13 | 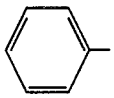 | 2 | 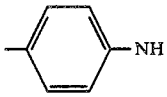 | H | —CO— | 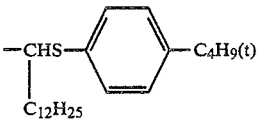 |
| I-14 | —$CH_3$ | 3 | 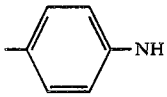 | H | —CO— | 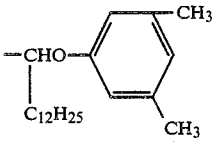 |
| I-15 | 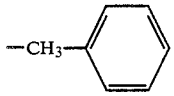 | 5 | 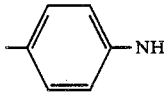 | H | —$SO_2$— | 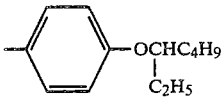 |
| I-16 | —$CH_3$ | 3 | 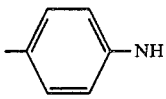 | Cl | —CO— | 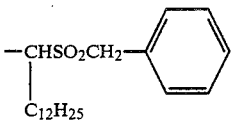 |

The pyrazolone-type coupler represented by Formula [II] will now be detailed below:

In Formula [II], the $R^4$ is an aryl group, and preferably a phenyl group. The phenyl group is allowed to have a substituent such as a halogen atom (e.g., fluorine, chlorine, bromine), alkyl group (e.g., methyl, ethyl), alkoxy group (e.g., methoxy, ethoxy), aryloxy group (e.g., phenyloxy, naphthoxy), acylamino group (e.g., benzamido, α-(2,4-di-t-amylphenoxy-butylamido), sulfonylamino group (e.g., benzenesulfonamido, n-hexadecanesulfonamido), sulfamoyl group (e.g., methylsulfamoyl, phenylsulfamoyl), carbamoyl group (e.g., n-butylcarbamoyl, phenylcarbamoyl), sulfonyl group (e.g., methylsulfonyl, n-dodecylsulfonyl, benzenesulfonyl), acyloxy group, ester group, carboxyl group, sulfo group, cyano group, nitro group, or the like.

Further, particular examples of the $R^4$ include phenyl, 2,4,6-trichlorophenyl, pentachlorophenyl, 2,4,6-trimethylphenyl, pentafluorophenyl, 2-chloro-4,6-dimethylphenyl, 2,6-dichloro-4-methylphenyl, 2,4-dichloro-6-methylphenyl, 2,4-dichloro-6-methoxyphenyl, 2,6-dichloro-4-methoxyphenyl, 2,6-dichloro-4-[α-(2,4-di-t-amylphenoxy)acetamido]phenyl, and the like.

The $R^5$ is an alkyl or aryl group. The alkyl group is preferably a straight-chain or branched-chain alkyl group having from 1 to 32 carbon atoms, which is allowed to have a substituent such as a halogen atom, an alkoxy, phenoxy, nitro, alkoxy, carbonyl, cyano, or the like group. The aryl group is preferably one having not less than 1 substituent, at least one of which substituents has from 1 to 32 carbon atoms, the substituent including alkyl, alkoxy, phenoxy, acylamino, sulfonamido, carbonylalkoxy, carbonylaryl, oxycarbonyl, carbamoyl, sulfamoyl, halogen atoms, nitro, cyano, succinimide, and the like groups.

The Z is a hydrogen atom or a group that can be split off by the coupling reaction thereof with the oxidized product of an aromatic primary amine color developing agent, the group being such as a halogen atom (e.g., chlorine, bromine), aryloxy group (e.g., phenyloxy, p-nitrophenyloxy), carbonyloxy group (e.g., acetyloxy, propionyloxy, m-chlorobenzoyloxy), alkoxy group (e.g., methoxy, butoxy), heterocyclyloxy group (e.g., cyclobentyloxy, cyclohexyloxy), sulfonyloxy group (e.g., methanesulfonyloxy, p-toluenesulfonyloxy), acyl group (e.g., acetyl, benzoyl), thiocyano group, alkylthio group (e.g., ethylthio, benzylthio), arylthio group (e.g., p-t-butylphenylthio, phenylthio), heteroylthio group (e.g., 4-pyridylthio, 2-imidazolylthio), sulfonamido group (e.g., methanesulfonamido, benzenesulfonamido), phosphonyloxy group, or arylazo group (e.g., α-naphthylazo, p-methoxyphenylazo). The groups splitted off by the coupling reaction preferably include a halogen, an aryloxy, arylthio and alkylthio groups. Also, the coupling-off group represented by the Z represents a split-off group which is allowed to coupler further with the same or a different coupler through methylene and phenylmethine groups, oxyphenyleneoxy group, oxyphenylenecarbonylphenyleneoxy group or oxyphenylenesulfonylphenylene oxy group. In this instance the coupler contained in the Z is combined at the coupling position with a coupling group.

In this invention, it is preferred that the 1H-pyrazole [3,2-C]-s-triazole-type magenta coupler is a coupler represented by the Formula [I] in which X is a halogen, and that the pyrazolone-type magenta coupler is a coupler represented by the Formula [II] in which Z is a group capable of splitting off by the coupling reaction with the oxidant of an aromatic primary amine color developing agent.

The following are the preferred examples of those compounds (couplers) having Formula [II], but the present invention is not limited thereto.

Formula [II]

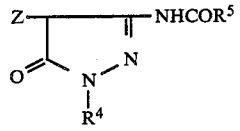

| Coupler | $R^4$ | $R^5$ | Z |
|---|---|---|---|
| II-1 | 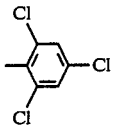 | 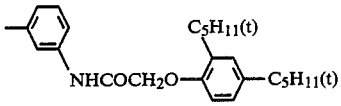 | H |
| II-2 | 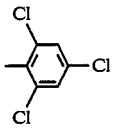 | 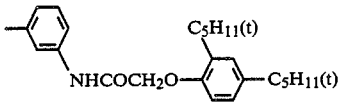 | 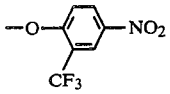 |
| II-3 | 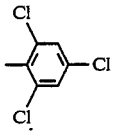 | 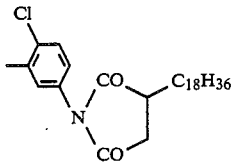 | H |
| II-4 | 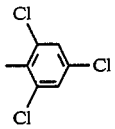 | 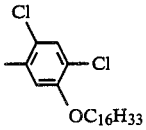 | 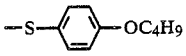 |
| II-5 | 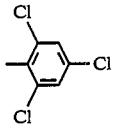 | 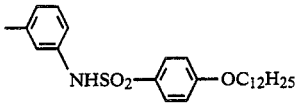 | H |
| II-6 | 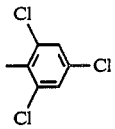 | 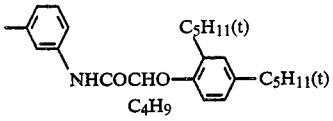 | H |
| II-7 | 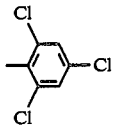 | $C_{17}H_{35}$— | H |

-continued
Formula [II]
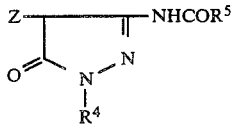
| Coupler | $R^4$ | $R^5$ | Z |
|---|---|---|---|
| II-8 | 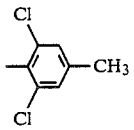 | 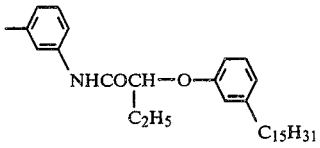 | H |
| II-9 | 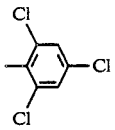 | 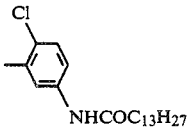 | 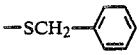 |
| II-10 | 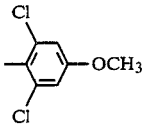 | 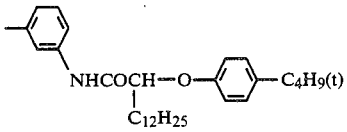 | H |
| II-11 | 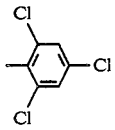 | 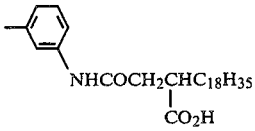 | H |
| II-12 | 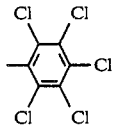 | 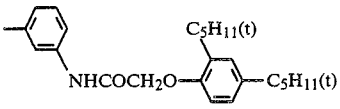 | H |
| II-13 | 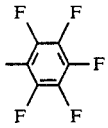 | 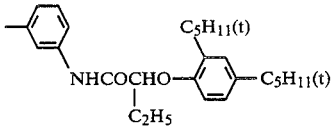 | H |
| II-14 | 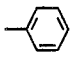 | 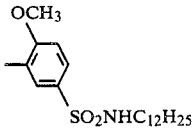 | H |
| II-15 | 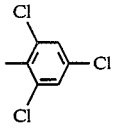 | 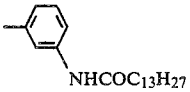 | H |
| II-16 | 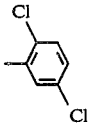 | 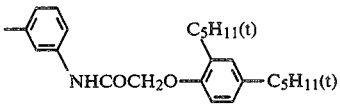 | H |

-continued

Formula [II]

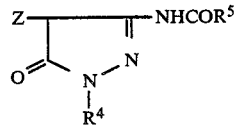

| Coupler | $R^4$ | $R^5$ | Z |
|---|---|---|---|
| II-17 | 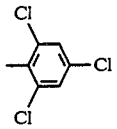 | 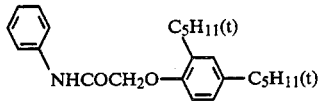 | 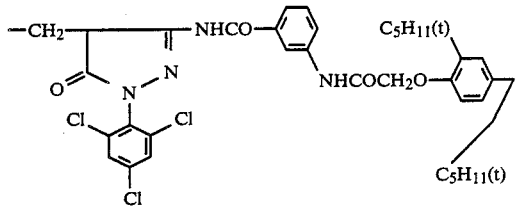 |
| II-18 | 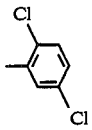 | 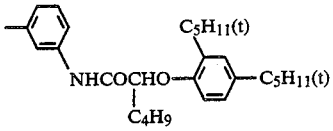 | 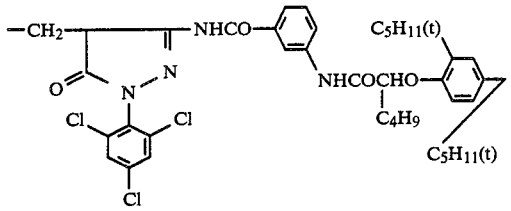 |
| II-19 | 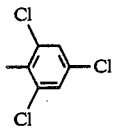 | 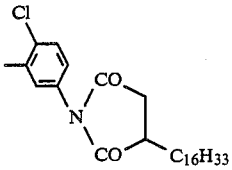 | 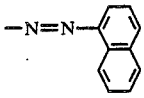 |
| II-20 | 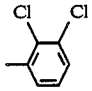 | 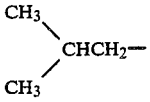 | 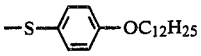 |
| II-21 | 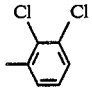 | 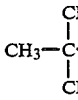 | 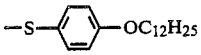 |
| II-22 | 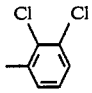 | $CH_3CH_2CH_2-$ | 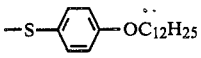 |
| II-23 | 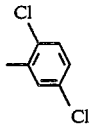 | 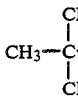 | 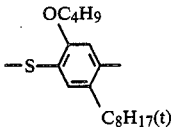 |
| II-24 | 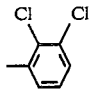 | 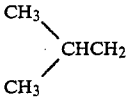 | 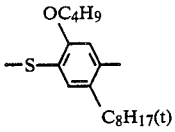 |

In the silver halide color photographic light-sensitive material of this invention, the silver halide emulsion layer may be comprised of a single layer or of not less than two emulsion layers substantially identical in the wavelength region to which they are sensitive or different in the speed. Where the silver halide emulsion layer comprises two or more emulsion layers, these emulsion layers may be either adjacent to each other or positioned apart with another silver halide emulsion layer different in the wavelength region to which it is sensitive, a non-light-sensitive hydrophilic colloidal layer or a layer for different purposes therebetween.

The non-light-sensitive hydrophilic colloidal layer includes, e.g., interlayer, antihalation layer, yellow colloidal layer and protective layer.

When incorporating the 1H-pyrazolo[3,2-C]-s-triazole-type magenta coupler of this invention into the emulsion layer, the adding amount of it is normally from 0.005 to 2 moles, and preferably from 0.01 to 0.5 mole per mole of silver halide.

Where at least one of the silver halide emulsion layers of this invention is comprised of two or more emulsion layers substantially identical in the color sensitivity, the respective layers may be, for example, substantially identical in the speed or different in the speed such that the one located far from the support is a higher-speed emulsion layer, while the other near the support is a lower-speed emulsion layer.

In this instance, the 1H-pyrazolo[3,2-C]-s-triazole-type magenta coupler and pyrazolone-type magenta coupler in this invention may be incorporated into any of the emulsion layers. In this case, both the couplers may be incorporated into any one of more same emulsion layers. The incorporation of the couplers may be carried out in several manners: The 1H-pyrazolo-[3,2-C]-s-triazole-type magenta coupler is incorporated into a high-speed emulsion layer, while the pyrazolone-type magenta coupler into a low-speed emulsion layer; the former is incorporated into the low-speed emulsion layer, while the latter into the high-speed emulsion layer; both the former and the latter are incorporated into the high-speed emulsion layer and either the former or the latter into the low-speed emulsion layer; both the former and the latter are incorporated into the low-speed emulsion layer and either the former or the latter into the high-speed emulsion layer; and both the former and the latter are incorporated into each of the high- and low-speed emulsion layers. The preferred ones among these manners are the manner in which both couplers are incorporated into the high-speed emulsion layer and the 1H-pyrazolo[3,2-C]-s-triazole-type magenta coupler into the low-speed emulsion layer and another manner in which the 1H-pyrazolo[3,2-C]-s-triazole-type magenta coupler is incorporated into the high-speed emulsion layer, while the pyrazolone-type magenta coupler into the low-speed emulsion layer. As for the proportion of the pyrazolone-type magenta coupler to the 1H-pyrazolo[3,2-C]-s-triazole-type magenta coupler, when both are added to a same emulsion layer, the former is desirable to be incorporated in the range of from 0.1 to 2 moles, and more preferably from 0.1 to 1.5 moles per mole of the latter. When the couplers are incorporated separately into different layers, the proportion is such that the coupler for the high-speed emulsion layer is in the range of from 0.1 to 1 mole, and preferably from 0.1 to 0.5 mole per mole of the coupler for the low-speed emulsion layer.

The 1H-pyrazolo[3,2-C]-s-triazole-type magenta coupler of this invention is desirable to be added in the range of from 0.05 to 1 mole, and more preferably from 0.05 to 0.5 mole per mole of the pyrazolone-type magenta coupler contained in the whole silver halide light-sensitive material.

Each of the 1H-pyrazolo[3,2-C]-s-triazole-type magenta coupler and pyrazolone-type magenta coupler in this invention may be dissolved in a high-boiling solvent and then dispersed into the emulsion in the manner as described in U.S. Pat. No. 2,322,027. Alternatively, they may also be dissolved into an aqueous alkaline solution or a hydrophilic organic solvent (such as methanol, ethanol, acetone, or the like) to be incorporated into the emulsion.

The magenta couplers of this invention may be used in combination with colorless couplers, colored couplers or DIR compounds and incorporated in an emulsified mixture thereof with the magenta couplers into the silver halide emulsion, or otherwise in the separately emulsified mixtures thereof with the respective magenta couplers into the silver halide emulsion.

The compounds of Formula [I] and [II] in this invention may be used in any various silver halide color photographic light-sensitive materials such as those light-sensitive materials for color photography use, for false color photography use, etc.; particularly in those for general color photography use, for color X-ray use, for diffusion transfer-type color process use, and the like.

The silver halide color photographic light-sensitive material of this invention is allowed to use those two-equivalent or four-equivalent couplers of the prior art.

Those yellow couplers usable in this invention include open-chain ketomethylene compounds such as, e.g., pivalylacetanilide-type, benzoylacetanilide-type yellow couplers.

Those cyan couplers usable include naphthol-type and phenol-type cyan couplers.

Those colored magenta couplers generally usable as the masking coupler are those compounds obtained by substituting colorless magenta couplers with an arylazo group at the active site thereof.

Further, there may also be used those magenta couplers of the type that the dye formed therefrom runs out into a processing bath as a result of the reaction of the coupler with the oxidized product of a color developing agent.

Those colored cyan couplers generally usable as the masking coupler are those compounds obtained by substituting colorless cyan couplers with an arylazo group at the active site thereof. Further, there may also be used those colored cyan couplers of the type that the dye formed therefrom runs out into a processing bath as a result of the reaction of the coupler with the oxidized product of a color developing agent.

Also, for the improvement of the photographic characteristics of the light-sensitive material of this invention, those couplers forming colorless dyes, the so-called competing couplers, may be incorporated.

The emulsion layer or the non-light-sensitive colloid layer of the silver halide color photographic light-sensitive material of this invention may contain in combination reducing agents or oxidation inhibitors including, e.g., sulfites (sodium sulfite, potassium sulfite, etc.), hydrogensulfites (sodium hydrogensulfite, potassium hydrogensulfite, etc.), hydroxylamines (hydroxylamine, N-phenylhydroxylamine, etc.), sulfinic acids (sodium phenylsulfinate, etc.), hydrazines (N,N'-dimethylhydrazine, etc.), reductones (ascorbic acid, etc.), p-aminophenol, alkylhydroquinones, pyrogallol, resorcinol, 2,3-dihydroxynaphthalene, etc.), and the like.

In addition, in order to improve further the resistance to light of the magenta dye formed from the 1H-pyrazolo[3,2-C]-s-triazole-type magenta coupler of this invention, p-alkoxyphenols or phenolic compounds may be incorporated into either the emulsion layer containing the above magenta coupler or an layer adjacent thereto.

The layer construction of the silver halide color photographic light-sensitive material of this invention may be on the basis of the ordinary subtractive color process, and, as a rule, the fundamental layer construction thereof is comprised principally of three layers: a blue-sensitive layer containing an yellow coupler for the formation of an yellow dye, a green-sensitive layer containing a magenta coupler for the formation of a magenta dye, and a red-sensitive layer containing a cyan coupler for the formation of a cyan dye. Further, any of these layers of each of all these layers may be coated in the form of doubly superposed emulsion layers or of triply superposed emulsion layers, or the like, whereby the light-sensitive material can be improved on the various photographic characteristics thereof such as the color formability, color reproducibility, graininess of the formed dyes, and the like.

In addition to these fundamental emulsion layers, a protective layer as the topmost layer, interlayers of filter layers between the emulsion layers, a subbing layer as the bottom layer, and an antihalation layer on the back of the support, and the like, may be used, whereby the improvements on the protectivity, antistain effect, graininess, color reproducibility, adherence of the layers to the support can be carried out.

The silver halide used in the silver halide color photographic light-sensitive material of this invention includes arbitrary silver halides commonly used for ordinary silver halide photographic light-sensitive materials, such as silver chloride, silver bromide, silver iodide, silver chlorobromide, silver iodobromide, silver chloroiodide, and the like.

The above silver halide emulsion may be sensitized by use of those chemical sensitizers of the prior art, which include noble-metallic sensitizers, sulfur sensitizers, selenium sensitizers and reduction sensitizers, which may be used alone or in combination.

As the binder of the silver halide emulsion, those binder materials of the prior art may be used. Further, the silver halide emulsion of this invention may, at need, be spectrally sensitized by use of those sensitizing dyes of the prior art.

In order to prevent the possible deteriorating of the speed of or the possible occurrence of fog in the above silver halide emulsion in the course of the manufacture thereof, during the storage thereof, or during the processing thereof, into the emulsion may be incorporated various compounds including such heterocyclic compounds and mercapto compounds as 1-phenyl-5-mercaptotetrazole, 3-methylbenzothiazole, 4-hydroxy-6-methyl-1,3,3a,7-tetrazaindene, and metallic salts, and the like.

The hardening of the emulsion of this invention may be carried out in usual manner.

Into the emulsion of this invention various surface active agents may be used alone or in a mixture thereof, the surface active agents including those used as the coating aid, emulsifying agent, agent for improving the permeability of processing liquids into the emulsion layers, defoaming agent, antistatic agent, non-adherence agent, and agent for improving the photographic characteristics or for controlling the physical properties of the light-sensitive material.

The color developing liquid for use in developing the silver halide color photographic light-sensitive material of this invention is an aqueous alkaline solution containing a developing agent, whose pH is not less than 8, and preferably from 9 to 12, the developing agent being an aromatic primary amine developing agent which includes those compounds capable of developing the exposed silver halide to light and which consists of an aromatic cyclic ring having thereon a primary amino group, and the precursors thereof.

The typical examples of the above developing agent are p-phenylenediamine-type compounds, of which the preferred ones include 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethyl-4-amino-N,N-diethylaniline, 3-methoxy-4-amino-N-ethyl--N-β-hydroxyethylaniline, 3-methoxy-4-amino-N-ethyl-N-N-β-methoxyethylaniline, 3-acetamido-4-amino-N,N-diethylaniline, 4-amino-N,N-dimethylaniline, N-ethyl-Nβ-β[β-(β-methoxyethoxy) ethoxy]ethyl-3-methyl-4-aminoaniline, N-ethyl-Nβ-(β-methoxyethoxy)ethyl-3-methyl-4-aminoaniline, and the salts of these compounds such as sulfates, hydrochlorides, sulfites, p-toluenesulfonates, and the like. Into a color developer liquid containing any of these color developing agents may, if necessary, be added various additives.

The color photographic light-sensitive material of this invention, after being exposed to light and color-developed, may be bleached in usual manner. The bleaching may be performed either simultaneously with or separately from fixation. The bleaching liquid, if a fixing agent is added thereto, may be used as a bleach-fix bath. As the bleaching agent various compounds are used, and various additives including bleach accelerating agents may be added thereto.

The present invention will be made practical reality in silver halide color photographic light-sensitive materials of various types. One of the types is such that a light-sensitive material having on the support thereof a silver halide emulsion layer containing a nondiffusible coupler is processed in an alkaline developer liquid containing an aromatic primary aminetype color developing agent to thereby render the formed water-insoluble or nondiffusible dye remain in the emulsion layer. Another type is such that a photographic light-sensitive material having on the support thereof a silver halide emulsion layer combined with a nondiffusible coupler is processed in an aqueous alkaline solution containing an aromatic primary aminetype color developing agent to thereby produce a diffusible dye that is soluble in an aqueous solvent, and the produced dye is then transferred onto an image receiving layer comprised of a different hydrophilic colloid; i.e., the diffusion transfer process.

The preferred embodiment of this invention will be given below: (1) A silver halide color photographic light-sensitive material having at least one green-sensitive silver halide emulsion layer containing couplers having Formulas [I] and [II]. (2) A silver halide color photographic light-sensitive material having a green-sensitive high-speed silver halide emulsion layer which contains at least one coupler having Formula [I], wherein the X is a halogen atom and which also contains at least one coupler having Formula [I], wherein the Z is a group other than a hydrogen atom. (3) A silver halide color photographic light-sensitive material of the above embodiment (2), wherein the green-sensitive high-speed silver halide emulsion layer contains the coupler having Formula [I] in the range of from 0.1 to 1.5 mole per mole of the coupler having Formula [II], the said light-sensitive material having also a green-sensitive low-speed silver halide emulsion layer containing a coupler having Formula [I]. (4) A silver halide color photographic light-sensitive material having a green-sensitive high-speed silver halide emulsion layer and a green-sensitive low-speed silver halide emulsion layer, the green-sensitive high-speed silver halide emulsion layer containing at least one coupler having Formula

[I], wherein the X is a halogen atom, the green-sensitive low-speed silver halide emulsion layer containing at least one coupler having Formula [I], wherein the Z is a hydrogen atom. (5) A silver halide color photographic light-sensitive material of the embodiment (4), wherein the coupler having Formula [I] is contained in the range of from 0.1 to 0.5 mole per mole of the coupler having Formula [I].

EXAMPLES

The present invention will be illustrated by the following examples, but the invention is not limited thereto.

Example 1

Zero point one mole per mole of silver of each of the 1H-pyrazolo[3,2-C]-triazole magenta coupler of this invention as given in Table 1 and the couplers as shown hereinafter or in Table 1 was taken, and to each of the above couplers was added the quantity as given in Table 1 of each of the couplers to be combinedly used therewith as given in Table 1, and to each of the mixtures was further added a mixture of tricresyl phosphate in the same quantity by weight as that of and ethyl acetate in a quantity three times by weight that of the above coupler mixture, and the whole mixture was heated to 60° C. to be completely dissolved. This solution was mixed with 200 ml of an aqueous 5% gelatin solution containing 20 ml of an aqueous 5% Alkanol B (alkylene-naphthalene sulfonate, a product of DuPont) solution, and this mixture was emulsifiedly dispersed by means of a colloid mill to thereby obtain an emulsified product. After that, the dispersed liquid was incorporated into 1 kg of a green-sensitive silver iodobromide emulsion (containing 6 mole % silver iodide), and to this were further added 20 ml of a 2% (water:methanol=1:1) solution of 1,2-bis(vinyl-sulfonyl)ethane, and the resulting liquid was coated and then dried on a subbed transparent polyester base, whereby Samples (1-1) to (1-17) were prepared. (Coated amount of the couplers: $2.1\times10^{-5}$ mole/100cm$^2$)

The thus obtained samples each was exposed through an optical wedge to light in usual manner, and then processed in accordance with the following processing procedure steps. The results are as given in Table 1.

| Processing step (at 38° C.) | Processing period |
|---|---|
| Color developing | 3 min. & 15 sec. |
| Bleaching | 1 min. & 30 sec. |
| Washing | 3 min. & 15 sec. |
| Fixing | 6 min. & 30 sec. |
| Washing | 3 min. & 15 sec. |
| Stabilizing | 1 min. & 30 sec. |

The compositions of the processing liquids used in the respective processing procedure steps are as follows:

| Color developer: | |
|---|---|
| 4-amino-3-methyl-N—ethyl-N—(β-hydroxyethyl)aniline sulfate | 4.75 g |
| Anhydrous sodium sulfite | 4.25 g |
| Hydroxyamine ½ sulfate | 2.0 g |
| Anhydrous potassium carbonate | 37.5 g |
| Sodium bromide | 1.3 g |
| Trisodium nitrilotriacetate, monohydrated | 2.5 g |
| Potassium hydroxide | 1.0 g |
| Water to make 1 liter, use potassium hydroxide to adjust the pH to 10.0. | |

-continued

| Bleaching bath: | |
|---|---|
| Iron-ammonium ethylenediamine tetraacetate | 100.0 g |
| Diammonium ethylenediamine tetraacetate | 10.0 g |
| Ammonium bromide | 150.0 g |
| Glacial acetic acid | 10.0 ml |
| Water to make 1 liter, use aqueous ammonia to adjust the pH to 6.0. | |

| Fixer: | |
|---|---|
| Ammonium thiosulfate (aqueous 5% solution) | 162 ml |
| Anhydrous sodium sulfite | 12.4 g |
| Water to make 1 liter, use acetic acid to adjust the pH to 6.5. | |

| Stabilizing bath: | |
|---|---|
| Formalin (aqueous 37% solution) | 5.0 ml |
| Koniducks (a product of Konishiroku Photo Industry Co., Ltd.) | 7.5 ml |
| Water to make 1 liter | |

Coupler [A]

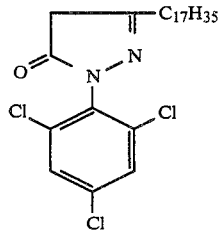

Coupler [B]

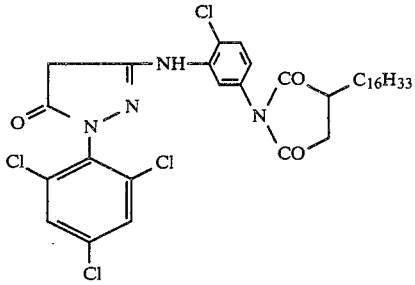

Coupler [C]

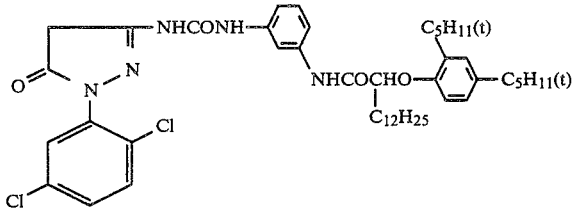

Coupler [D]

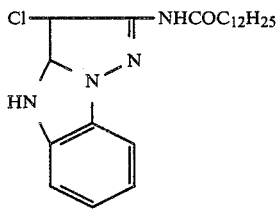

Coupler [E]

-continued

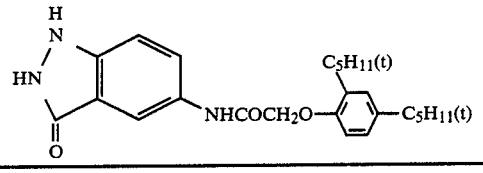

TABLE 2-continued

| Sample | Relative*1 speed | Maximum density | Resistance*2 to formalin |
|---|---|---|---|
| 13 | 110 | 2.88 | 56 |

Note:

*1The relative speed in Table 2 is a value relative to the speed of Sample 1 regarded as 100, the speed being the reciprocal of a value giving a fog density plus 0.1.

$$*^2\text{Resistance to formalin} = \frac{\text{The maximum color density of formaline-processed sample}}{\text{The maximum color density of sample not subjected to formalin}} \times 100(\%)$$

TABLE 1

| Sample | Coupler | Coupler in combination | λmax (nm) | ΔλL (nm)* | ΔλS (nm)* | Adding q'ty of coupler in combination |
|---|---|---|---|---|---|---|
| 1-1 | Exemplified Compound (1-2) | — | 546 | 49 | 54 | — |
| 1-2 | Exemplified Compound (1-2) | Coupler [A] | 540 | 65 | 68 | 0.5 |
| 1-3 | Exemplified Compound (1-2) | Coupler [B] | 540 | 50 | 55 | " |
| 1-4 | Exemplified Compound (1-2) | Coupler [C] | 545 | 63 | 57 | " |
| 1-5 | Exemplified Compound (1-2) | Coupler [D] | 565 | 65 | 62 | " |
| 1-6 | Exemplified Compound (1-2) | Coupler [E] | 558 | 60 | 65 | " |
| 1-7 | Exemplified Compound (1-2) | Exemplified Compound (II-1) | 552 | 50 | 55 | " |
| 1-8 | Exemplified Compound (1-2) | Exemplified Compound (II-2) | 553 | 51 | 54 | " |
| 1-9 | Exemplified Compound (1-2) | Exemplified Compound (II-17) | 551 | 50 | 56 | " |
| 1-10 | Coupler [B] | — | 543 | 54 | 53 | — |
| 1-11 | Coupler [D] | — | 579 | 67 | 65 | — |
| 1-12 | Exemplified Compound (II-1) | — | 554 | 63 | 56 | — |
| 1-13 | Exemplified Compound (II-17) | — | 551 | 63 | 57 | — |

Note*

If the density at λmax is regarded as 1.0, the difference in the wavelength from the λmax when the density on the shorter wavelength side becomes 0.4 is ΔλS, while the difference in the wavelength from the λmax when the density on the longer wavelength side becomes 0.2 is ΔλL.

From the results shown in Table 1, it is understood that the 1H-pyrazolor[3,2-C]-s-triazole-type magenta coupler, when used alone, has the formed color therefrom on the shorter wavelength side than the objective λmax, but, when used in combination with the pyrazolone-type coupler, has the λmax of the formed color therefrom fall under the objective λmax range.

Example 2

Two each of the Samples 1-1 to 1-13 obtained in the foregoing Example-1 were prepared. One each of the samples was allowed to stand over a period of four days in an airtight container with an aqueous 2% formalin solution placed therein at the bottom thereof, wherein the inside air was conditioned at 30° C./62%RH. The other each of the samples was also allowed to stand for the same period in a similar airtight container under the same atmospheric condition but not containing formalin. Each of the above samples was exposed to light and then processed in the same manner as in Example-1 to examine the coupler's resistance to a formalin fume. The results obtained from the examination are as given in Table 2.

TABLE 2

| Sample | Relative*1 speed | Maximum density | Resistance*2 to formalin |
|---|---|---|---|
| 1 | 100 | 2.83 | 80 |
| 2 | 80 | 2.30 | 51 |
| 3 | 85 | 2.92 | 30 |
| 4 | 87 | 2.82 | 45 |
| 5 | 60 | 2.33 | 70 |
| 6 | 63 | 2.20 | 65 |
| 7 | 97 | 2.82 | 89 |
| 8 | 105 | 3.00 | 92 |
| 9 | 104 | 3.01 | 91 |
| 10 | 80 | 3.07 | 20 |
| 11 | 50 | 1.82 | 60 |
| 12 | 52 | 2.07 | 48 |

From the results given in Table 2, it is understood that more favorable formalin-resistant effects can be recognized in the combined use of the 1H-pyrazolo[3,2-C]-s-triazole-type magenta coupler with the pyrazolone-type magenta coupler of this invention than in the single use of the former. Since the combined use is more excellent in the formalin resistance than the single use, the combination of the couplers of this invention has much significant effects beyond the expectation from the single use of the coupler.

Example 3

The couplers in the combinations as in Table 3 were dispersed and coated in the same manner as in Example-1, whereby Samples (14) to (25) were prepared. The obtained results are as given in Table 3.

TABLE 3

| Sample | Coupler | Coupler in combination | λmax | Resistance to formalin |
|---|---|---|---|---|
| 14 | I-1 | — | 543 | 79 |
| 15 | " | II-1 | 551 | 89 |
| 16 | " | II-5 | 550 | 90 |
| 17 | " | II-17 | 552 | 91 |
| 18 | I-3 | — | 543 | 80 |
| 19 | " | II-2 | 550 | 90 |
| 20 | " | II-6 | 553 | 93 |
| 21 | " | II-16 | 551 | 92 |
| 22 | I-8 | — | 545 | 80 |
| 23 | " | II-15 | 554 | 91 |
| 24 | " | II-18 | 552 | 90 |
| 25 | " | II-20 | 550 | 90 |

Also from Table 3, it is understood that the samples containing the 1H-pyrazolo[3,2-C]-s-triazole-type magenta couplers alone show that the respective λmaxs thereof are in the shorter wavelength side and the respective resistances thereof to formalin are unsatisfactory, while the other samples containing the above magenta couplers in combination with the pyrazolone-type magenta couplers show that all these characteristics are improved.

Example 4

The couplers in the low-speed layer as shown in Table 4 were each dispersed in the same manner as in Example-1 and then coated in the same manner as in Example-1 except that a green-sensitive low-speed silver iodobromide emulsion (containing 4 mole % silver iodide) with a mean silver halide particle size of 0.5μ was used, whereby green-sensitive low-speed layer samples were prepared. On the obtained samples the couplers in the high-speed layer as shown in Table 4, which were each incorporated into a green-sensitive high-speed silver iodobromide emulsion (containing 7 mole % silver iodide) with a mean silver halide particle size of 1.2 μ, were further coated in the same manner as in Example-1 so that the silver amount per unit area thereof is equal to that of the underneath layer, whereby double-layer Samples (26) to (36) were obtained. The obtained samples each was exposed to light and processed in the same manner as in Example-1. The obtained results are as given in Table 4. Also, the results obtained with respect to the formalin-resistant effects found in the same manner as in Example-2 are shown in Table 4.

TABLE 4

| | Low-speed layer | | High-speed layer | | | Resistance | |
|---|---|---|---|---|---|---|---|
| Sample | Coupler | Adding q'ty | Coupler | Adding q'ty | λmax | to formalin | Remarks |
| 26 | I-8 | 0.10 | I-8 | 0.02 | 545 | 80 | Comparative |
| 27 | II-1 | 0.10 | I-8 | " | 553 | 90 | Invention |
| 28 | II-5 | 0.10 | I-8 | " | 552 | 92 | " |
| 29 | II-6 | 0.10 | I-8 | " | 551 | 91 | " |
| 30 | I-8 | 0.10 | I-8 | 0.01 | 551 | 90 | " |
| | | | II-2 | 0.01 | | | |
| 31 | I-8 | 0.10 | I-8 | 0.01 | 551 | 89 | " |
| | | | II-17 | 0.01 | | | |
| 32 | I-8 | 0.10 | I-8 | 0.01 | 552 | 91 | " |
| | | | II-18 | 0.01 | | | |
| 33 | I-8 | 0.05 | I-8 | 0.02 | 550 | 89 | " |
| | II-1 | 0.05 | | | | | |
| 34 | I-8 | 0.05 | II-17 | " | 551 | 89 | " |
| | II-1 | 0.05 | | | | | |
| 35 | I-8 | 0.05 | I-8 | 0.01 | 552 | 91 | " |
| | II-1 | 0.05 | II-17 | 0.01 | | | |
| 36 | Comparative coupler B | 0.10 | I-8 | 0.02 | 543 | 30 | Comparative |

From Table 4 it is apparent that the combined use of the 1H-pyrazolo[3,2-C]-s-triazole-type magenta coupler with the pyrazolone-type magenta coupler of this invention, whether they are incorporated into the same emulsion or separately into different emulsions, improve their λmax so as to be shifted toward the longer wavelength side, and also improve the resistance to formalin. On the other hand, the combined use of couplers outside this invention with the coupler of this invention makes no contribution to any such improvements.

What is claimed is:

1. In a silver halide color photographic light-sensitive material comprising a support having thereon at least one silver halide emulsion layer, said silver halide color photographic light-sensitive material wherein said at least one silver halide emulsion layer comprises a 1H-pyrazolo[3,2-C]-s-triazole-type magenta coupler, and said silver halide emulsion layer containing said magenta coupler and/or a silver halide emulsion layer having substantially the same color sensitivity as said silver halide emulsion layer containing said magenta coupler comprises a pyrazolone-type magenta coupler.

2. The silver halide color photographic light-sensitive material of claim 1, wherein said pyrazolone-type magenta coupler has Formula [II]

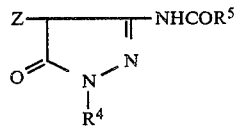

Formula [II]

wherein $R^4$ is an aryl group, $R^5$ is an alkyl or aryl group, Z is a hydrogen atom or a group that can be split off by the coupling reaction thereof with the oxidized product of an aromatic primary amine color developing agent.

3. The silver halide color photographic light-sensitive material of claim 1, wherein said 1H-pyrazolo[3,2-C]-s-triazole-type magenta coupler has Formula [I]

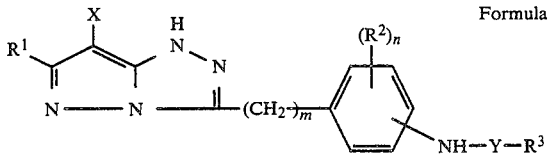

Formula [I]

wherein $R^1$ is an alkyl or aryl group, $R^2$ is a monovalent organic group, $R^3$ is an alkyl, aryl or heterocyclic group, Y is a carbonyl or sulfonyl group, X is a hydrogen atom or a group that can be split off by the coupling reaction thereof with the oxidized product of an aromatic primary amine color developing agent, m is an integer of from zero to 5, and n is an integer of from zero to 4.

4. The silver halide color photographic light-sensitive material of claim 3, wherein X of Formula [I] represents a halogen atom represents a group capable of splitting off through a coupling reaction with the oxidized product of an aromatic primary amine developing agent.

5. The silver halide color photographic light-sensitive material of claim 3, wherein $R^1$ of Formula [I] represents an alkyl group having one to eight carbon atoms.

6. The silver halide color photographic light-sensitive material of claim 3, wherein $R^2$ of Formula [I] represents a halogen atom, an alkoxy group, an alkyl group, a nitro group, an alkoxycarbonyl group or a cyano group.

7. The silver halide color photographic light-sensitive material of claim 3, wherein the alkyl group represented by $R^3$ of Formula [I] has 4 to 32 carbon atoms.

8. The silver halide color photographic light-sensitive material of claim 2, wherein the group to be splitted off by a coupling reaction with the oxidized product of the aromatic primary amine developing agent said group represented by Z in Formula [I] is a halogen atom, an aryloxy group, an arylthio group or an alkylthio group.

9. The silver halide color photographic light-sensitive material of claim 1, wherein at least one of the silver halide emulsion layers comprises a high-speed emulsion layer located far from the support and a low-speed emulsion layer located near the support, both of which are substantially identical in the color sensitivity, and the former emulsion layer contains the 1H-pyrazole[3,2C]-s-triazole-type magenta coupler and the pyrazolone-type magenta coupler and the latter emulsion layer contains the 1H-pyrazolo [3,2C]-s-triazole-type magenta coupler.

10. The silver halide color photographic light-sensitive material of claim 1, wherein at least one of the silver halide emulsion layers comprises a high-speed emulsion layer located far from the support and a low-speed emulsion layer located near the support, both of which are substantially identical in the color sensitivity, and the former emulsion layer contains the 1H-pyrazole [3,2-C]-s-triazole-type magenta coupler and the latter emulsion layer contains the pyrazolone-type magenta coupler.

11. The silver halide color photographic light-sensitive material of claim 1, wherein the silver halide emulsion layers substantially identical in the color sensitivity are green-sensitive.

12. The silver halide color photographic light-sensitive material of claim 2, wherein Z of Formula [I] represents a group capable of splitting off through a coupling reaction with the oxidized product of an aromatic primary amine developing agent.

* * * * *